United States Patent [19]

Pawloski

[11] 3,999,271

[45] Dec. 28, 1976

[54] TERMINAL BLOCK INSTALLATION TOOL

[76] Inventor: James A. Pawloski, P.O. Box 155, Pomfret Center, Conn. 06259

[22] Filed: Aug. 1, 1975

[21] Appl. No.: 601,321

[52] U.S. Cl. ..... 29/203 HC; 29/203 H; 173/120

[51] Int. Cl.[2] ..... H01R 43/00

[58] Field of Search ..... 29/203 H, 203 HC, 203 R, 29/628; 7/14.1 R; 173/119, 120, 121

[56] References Cited

UNITED STATES PATENTS

| | | | |
|---|---|---|---|
| 2,080,130 | 5/1937 | Hansen | 173/119 |
| 3,279,044 | 10/1966 | Roper | 29/203 H |
| 3,708,852 | 1/1973 | Mason | 29/203 H |

FOREIGN PATENTS OR APPLICATIONS

| | | | |
|---|---|---|---|
| 636,889 | 4/1928 | France | 173/119 |

*Primary Examiner*—Carl E. Hall
*Attorney, Agent, or Firm*—Arthur T. Fattibene

[57] ABSTRACT

A terminal block installation tool which comprises a housing having a driving and cutting bit actuated by a piston ram which can be either manually actuated mechanically or pneumatically actuated by fluid pressure.

7 Claims, 9 Drawing Figures

TERMINAL BLOCK INSTALLATION TOOL

BRIEF SUMMARY OF THE INVENTION

This invention is directed to a hand terminal block installation tool which includes a housing having a chamber formed therein in which a piston ram is slideably disposed. Cooperatively associated with the piston ram is a driving and cutting tool bit. The driving and cutting tool is formed to accommodate a terminal pin adapted to receive a wire. When power is supplied to the piston ram, it is displaced within the chamber to impact the driving and cutting bit to sequentially drive the wire into the slot of a terminal pin and to trim or cut the excess wire.

A handle is connected to the housing for holding and actuating the tool. The handle includes a fixed portion and a movable portion. The free end of the movable portion is provided with a sear which extends through a slotted opening into the chamber to engage the ram piston. The arrangement is such that when the movable handle portion is squeezed, a retraction and release of the piston ram is effected to impart a sharp impact on the driving and cutting tool so as to effect the driving and cutting of a wire.

In an alternate construction, the tool can be fluid actuated to effect the impact between a slidable piston ram and an associated driving and cutting tool. In this form, a spring is disposed between the piston ram and the driving and cutting tool bit to maintain the driving and cutting tool in tension.

The features and advantages of this invention will become more readily apparent when considered in view of the drawings in which.

Figures 1, 2, 3, 8:
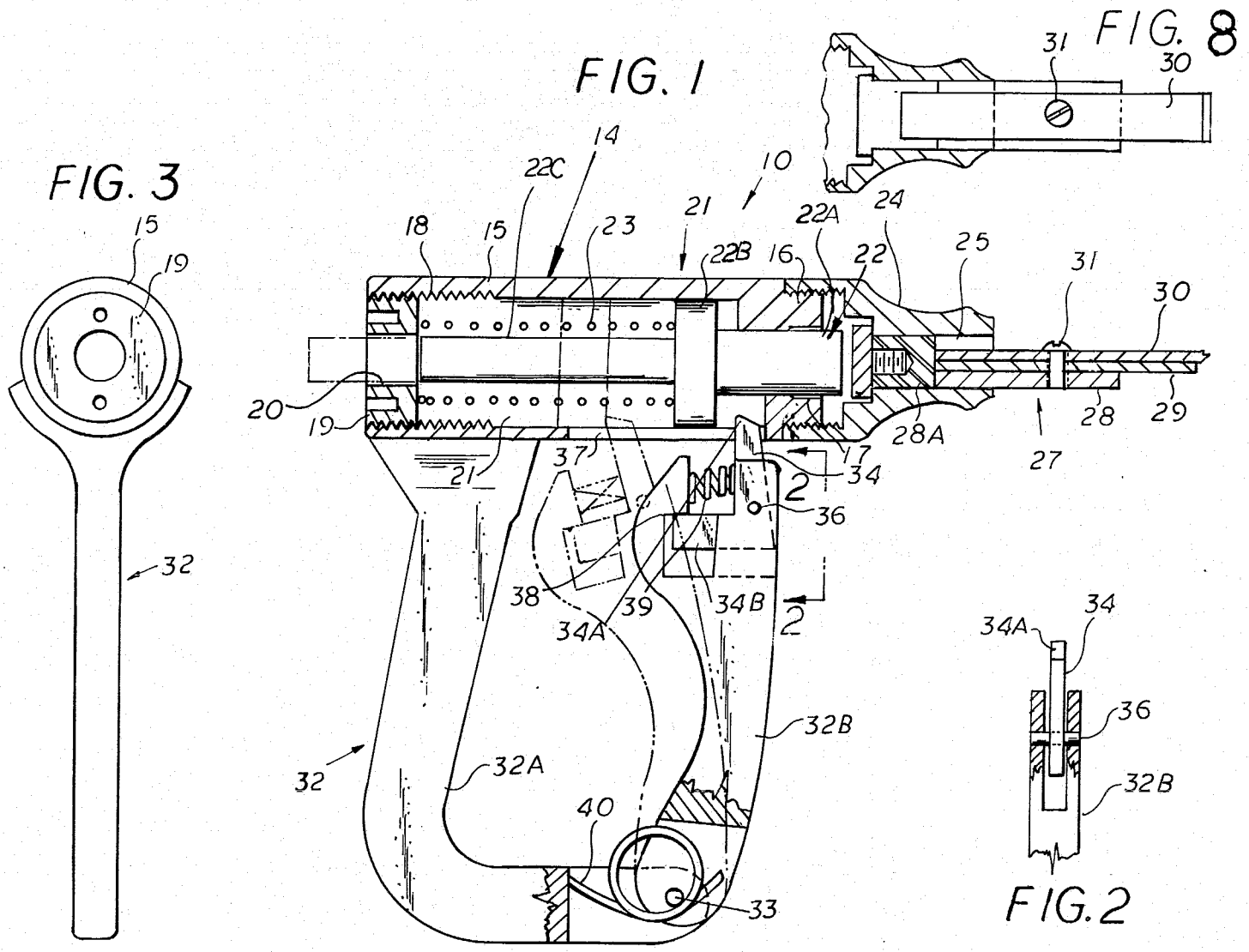
FIG. 1 is a section side view of a hand tool embodying the invention.
FIG. 2 is a detailed view of the upper end of the moveable handle portion of the tool taken along line 2—2 of FIG. 1.
FIG. 3 is an end view of FIG. 1.
FIG. 8 is a detail plan view of the tool bit.

Referring to the drawings, (FIG. 1) there is illustrated a hand tool 10 for use in making wire splices or connections to a pin of a terminal block. Generally, such terminal blocks include a vast number of closely spaced, slotted pin terminals 11 of the type illustrated in FIG. 4. As shown, such terminals 11 comprise a generally flat pin having a vertical slot 12 into which a wire 13 is forced. The electrical connection between the pin 11 and wire 13 is effected by a friction tight electrical-mechanical connection formed as the wire 13 is forced or driven into the slot 12 by the hand tool 10 to be described.

The hand tool 10 comprises a housing means 14 which is defined by a tubular body portion 15 having a connected front end wall 16. The front end wall 16 has an opening 17 extending therethrough. The rear end of the tubular body portion 15 is provided with internal threads 18 to which a rear end wall 19 is adjustably threaded. The rear wall 19 also has an opening 20 extending therethrough. Thus, a chamber 21 is defined within the tubular body 15.

Disposed with the chamber 21 is a piston ram 22. As shown, the piston ram 22 includes a ram head portion 22A, a connected piston 22B and stem portion 22C. The arrangement is such that the ram head portion 22A is arranged to extend through opening 17 in the front end wall 16, whereas the stem portion 22C is disposed in alignment with opening 20. A coil spring 23 interposed between the end wall 19 and the piston 22B normally bias the piston ram 22 toward an inoperative position.

Connected to the front end of the tubular body portion 15 is a nose cap 24. As shown, the nose cap 24 is formed with a rectangular or square shaped bore 25 through which a driving and cutting tool bit 27 projects, and which tool bit 27 has a complementary shaped portion which permits the tool to be orientated to four positions. The tool bit 27 comprises a mounting plates 28 having a drive head portion 28A which compliments the shape of the bore 25. A driver plate 29 having a slot formed therein is connected to the blade portion of the mounting plate; and a cutting plate 30 is superposed onto the drive plate 29. A suitable fastener 31 secures the cutting plate 30 and driver plate 29 to the mounting plate 28.

A handle means 32 is provided for facilitating the holding and actuating of the tool 10. The handle means 32 comprises a fixed portion 32A which is generally L shaped, the upper end being connected to the tubular body portion 15. A movable handle portion 32B is pivotally connected to the fixed portion by a pivot pin 33. As seen in FIG. 2, the upper end of the movable portion 32B is bifurcated, and an L shaped sear 34 is pivotally connected between the bifurcation by pin 36. The upper end of one leg 34A of sear 34 extends through a slotted opening 37 of the tubular body to extend into chamber 21. The upper end of sear 34 is disposed to engage the piston portion 22B of the ram 22. The end of the other leg 34B of sear 34 engages a stop shoulder 38 which is formed on a lateral projecting portion of the fixed handle portion 32B. A spring 39 biases the sear against stop shoulder 38. A second spring 40 normally biases the movable handle portion 32A toward an inoperative position as shown in FIG. 1 in the solid line showing.

Figure 4:
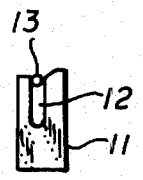
FIG. 4 is a detailed view of a terminal block pin to which the present tool is applicable.

In operation, with a wire 13 positioned in the mouth of a terminal pin 11 as shown in FIG. 4, the driving and cutting bit 27 of tool 10 is placed over the terminal. To drive the wire 13 into slot 12 of terminal 11 to make an electrical connection, the movable handle portion 32B is squeezed or disposed toward the fixed handle portion 32A. When this occurs, the sear 34 engages the piston portion 22B of the ram 22 to effect a retraction thereof against the bias of spring 23. As the movable handle portion pivots about pin 33, the radius is such that the sear 34 will effect an automatic release of the ram 22 after it has been retracted a predetermined distance. Upon the ram being released by the sear 34, the spring 23 will cause the ram 22 to impact against the drive head 28A of the tool bit 27 to result in the driver plate 29 driving the wire 13 down into slot 12. When the wire 12 is properly seated, the cutting blade 30 will trim the wire.

From the foregoing it will be noted that a simple and easily operated tool is provided for quickly and effectively making the necessary connections to a terminal block. By adjusting the position of the rear end wall 19 the tension or force of spring 23 can be controlled accordingly.

Figure 7:
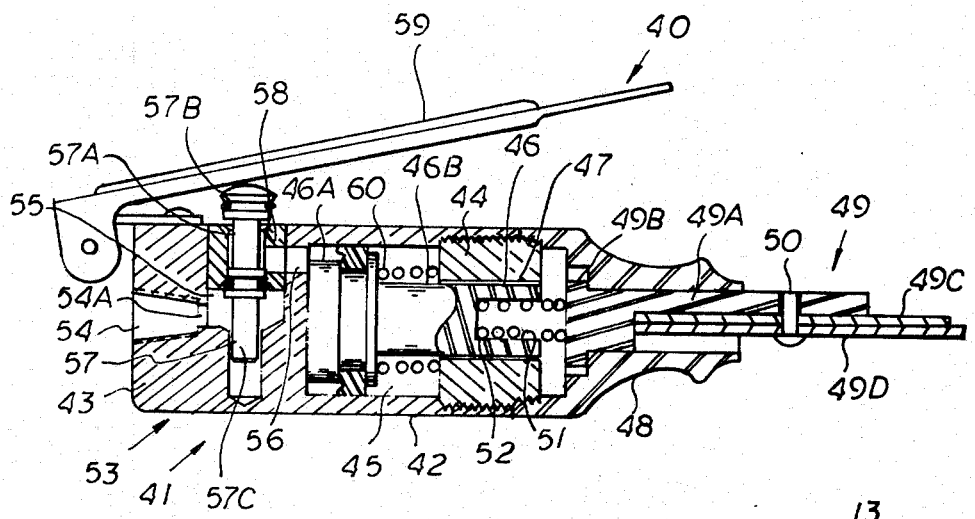
FIG. 7 is another modified form of the invention.

FIG. 7 illustrates a modified form of the invention. In this embodiment a fluid actuated or pneumatically operated tool 40 is shown. This embodiment comprises a power end portion 41 which includes a housing 42 having an end wall 43 and a front end wall 44. The front wall 44 may be threaded or pinned to the front end of the housing 42. Thus, there is defined within the housing 42 between the end walls 43 and 44 a chamber 45 in which a piston ram 46 is slideably mounted. The piston ram 46 includes a piston head portion 46A and a connected ram portion 46B. The ram portion 46B is disposed in axial alignment with an opening 47 formed in the front end wall 44, whereby the front end of the ram 46B projects through opening 47.

Connected to the front end of the housing 42 is a nose cap 48. The nose cap 48 carries the driving and cutting tool bit 49. The tool bit 49 is similar in construction to that described with respect to the tool 10 of FIG. 1. Tool bit 49 includes a mounting plate 49A which has formed or connected thereto a driving head 49B. Connected to the mounting plate 49A is an intermediate driver plate 49C and a superposed cutter plate 49D. The respective mounting plate, driver plate, and cutting plate are fastened by a bolt 50.

Formed in the front end of the ram 46B is a recess 51 in which a spring 52 is confined. As seen in FIG. 7, the spring 52 is confined between the ram 46B and the drive head 49B of the tool bit 49. In this manner the tool bit 49 is maintained under a spring tension.

A valve means 53 is provided to control the fluid pressure for activating the tool 40. Formed in the rear wall 43 is a fluid inlet 54 to which a hose, which is connected to a fluid pressure source, can be readily connected. It will be understood that if compressed air is utilized as the pressure fluid source, the air supply hose (not shown) can be readily coupled to the inlet 54.

The fluid inlet in turn is connected into communication with a valve chamber 55 formed in the wall 43. The valve chamber is connected by way of a port opening 56 to the piston chamber 45. Interposed within the valve chamber 55 is a valve member 57 to control the flow of fluid or compressed air from the inlet 54 to the outlet port 56. The valve member 57 includes a valve stem 57C having spaced apart valve heads 57A, 57B thereon. Valve head 57A valves the inlet port 54A, and valve head 57B valves the exhaust port 58. In a normal inoperative position, with the pressure hose (not shown) connected to the tool, the air pressure will normally maintain the valve member so that the inlet port 54A is closed and the exhaust port 58 opened to atmosphere. In this position, the upper valve head 57B normally extends above the exhaust port 58 with the head end of the valve member projecting slightly beyond the housing 42. When a valve actuator or handle 59 is depressed, it will force the valve member 57 downwardly as seen in FIG. 7 wherein the exhaust port 58 is sealed and the inlet port 54A is opened. In this position, fluid pressure is permitted to flow from inlet 54A to outlet 56 and into chamber 45 to effect the displacement of the piston ram 46 to the right as viewed in FIG. 7. When this occurs, the impact of ram 46B against the driving head 49B of the tool bit 49 will effect the driving of the wire to a terminal pin to make an electrical connection and trim the wire accordingly.

A spring 60 interposed between the piston head 46A and the front wall 44 will effect the return of the piston ram 46 toward its normal inoperative position upon release of the actuating handle 59. Upon the return of the piston ram 46 (i.e.; movement to the left as seen in FIG. 7 under the influence of spring 60) the fluid in chamber 45 is exhausted through port 56 to exhaust port 58.

Figure 6:
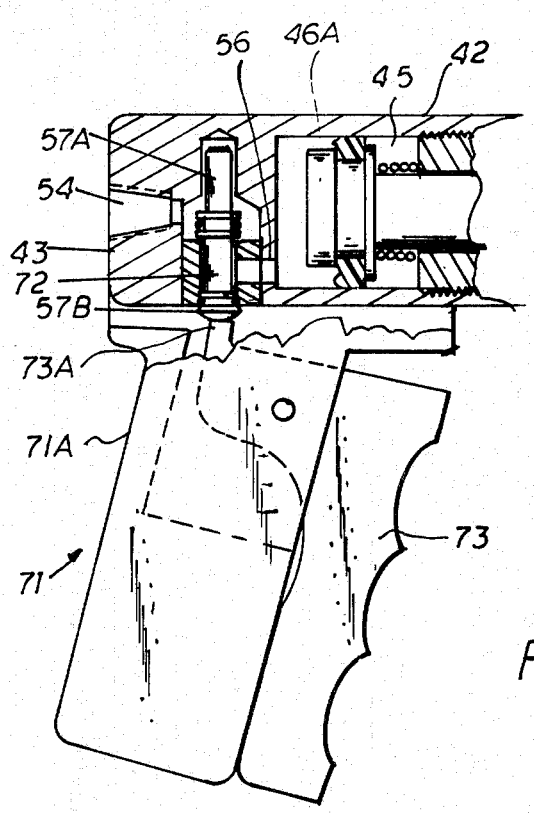
FIG. 6 is a fragmentary section view of the embodiment of FIGS. 5 and 5A showing the parts in operative positions.
Figure 5:
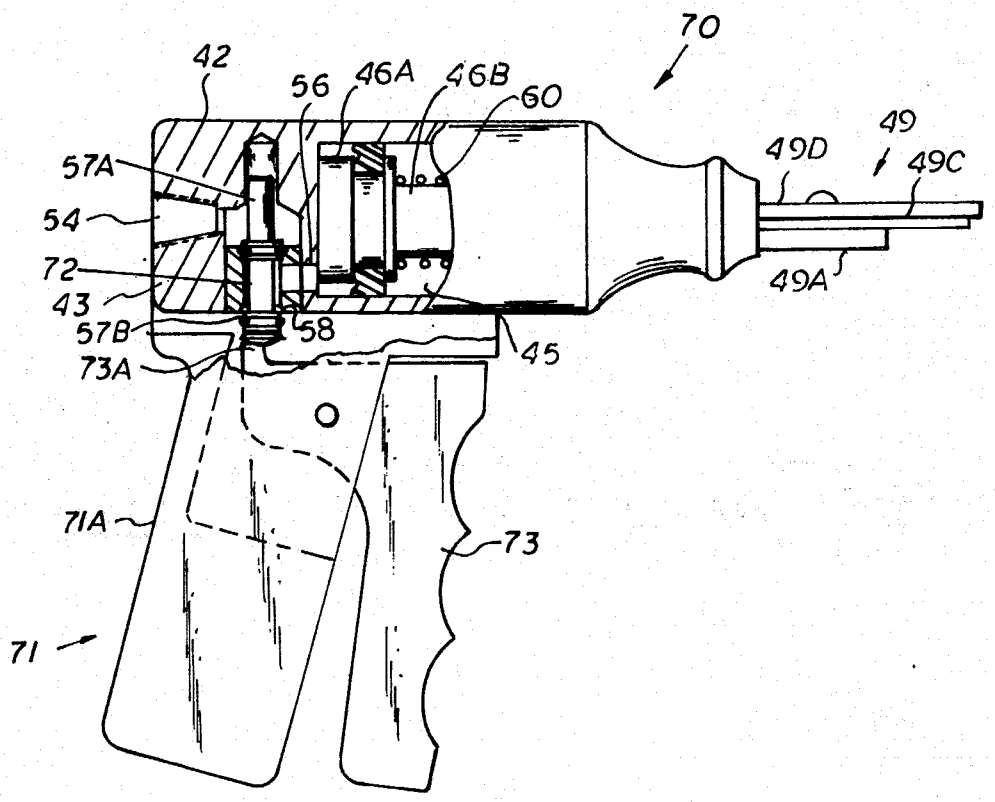
FIG. 5 is a side view of a modified form of the invention.
Figure 5A:
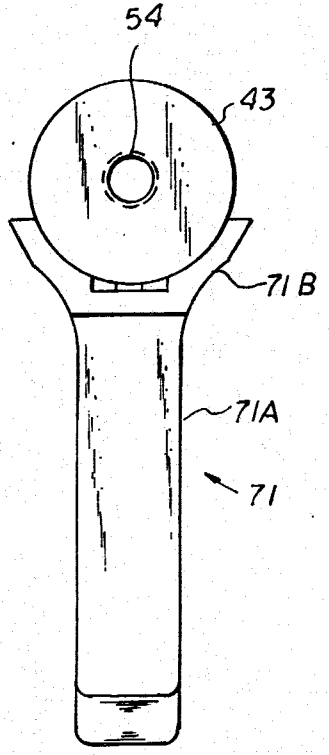
FIG. 5A is an end view of FIG. 5.

FIG. 5 illustrates a modified form of air tool of the type described with respect to FIG. 7. In this form of the invention, the tool 70 of FIG. 5 is similar to that of FIG. 7 with the exception that a "pistol type grip or handle 71" is utilized instead of a treadle lever handle 59 to actuate the valve member 72. As seen in FIGS. 5, 5A and 6 the pistol grip handle 71 includes a fixed handle portion 71A adapted to be received in the palm of an operator's hand. The upper end of the handle portion 71A is formed with a cradle 71B for attachment to the housing 42 of the tool 70. Suitable fastening means such as a screw, secures the handle portion 71 to the housing 42 of tool 70.

The housing 42 is attached to the handle portion 71 so that the valve member 72 is positioned directly toward the cradle portion 71B of the handle.

Pivotally connected to the fixed handle portion 71 is a trigger member 73. The trigger member 73 includes a hammer abutment 73A which is arranged to engage the head end of the valve member 72. Thus, when the trigger 73 is squeezed, the hammer abutment 73A engages the valve member to effect closing of the exhaust port 58 and opening of the inlet port to permit fluid pressure into the valve chamber 45 to effect the operation of the tool as hereinbefore described with respect to FIG. 7. In all other respects, the operation and construction of the tool of FIG. 5 is similar to that of FIG. 7.

While the invention has been described with respect to several embodiments thereof, it will be appreciated and understood that variations and modifications may be made without departing from the spirit or scope of the invention.

What is claimed is:

1. A hand tool for making an electrical connection between a wire and a slotted terminal pin comprising:

a housing means having a chamber formed therein, a piston ram slideably disposed in said chamber, a driving tool bit projecting from said housing means, said driving tool bit having a slot for accommodating a terminal pin, means for normally biasing said piston ram toward said driving tool bit, and a handle means connected to said housing for holding and actuating said tool whereby the actuation of said tool effects both the driving of a wire within the slot of a terminal pin to make an electrical connection and a cutting of the wire, said handle means including a fixed handle portion connected to said housing, and a moveable handle portion pivotally connected at one end to said fixed handle portion, said housing having a slotted opening therein, an actuating member connected to the other end of said moveable handle portion whereby said actuating member extends into said slotted opening, and a catch means connected to said piston ram for engaging with said actuating member whereby the co-action between said actuating member and catch means effects a retraction and release of said piston ram upon the rotation of said moveable handle portion about its pivotal connection relative to said fixed handle portion to drive said projecting driving tool bit to effect the driving and cutting of the wire relative to a terminal pin by imparting a sharp impact.

2. The invention as defined in claim 1 and including means for adjusting the driving force of said piston ram toward said driving tool bit.

3. The invention as defined in claim 1 wherein said actuating means includes:

a sear pivotally mounted to said other end of said movable handle portion, and complimentary means connected to said sear and movable handle portion to define a stop for said sear.

4. The invention as defined in claim 1 wherein said housing means includes:

a tubular body portion, said tubular body having a front end wall having an opening in said front end wall, a rear end wall, said rear end wall having an opening therein, means for adjustably positioning said rear end wall relative to said tubular body portion, said piston ram having opposed end portion adapted to extend through said openings in said front and rear end walls.

5. The invention as defined in claim 4, and including a nose cap connected to the front end of said tubular body portion, said driving tool bit projecting from said nose cap.

6. The invention as defined in claim 1 wherein said tool bit comprises:

a mounting plate having a connected driving head, a driver plate connected to said mounting plate, and a cutting plate connected to said mounting plate.

7. The invention as defined in claim 6 wherein said connected driving head is rectangular in cross-section to permit orientation of the tool to a plurality of positions.

* * * * *